United States Patent [19]

Kaczmarek et al.

[11] Patent Number: 4,644,703

[45] Date of Patent: Feb. 24, 1987

[54] PLURAL LAYERED COATED ABRASIVE

[75] Inventors: Wesley R. Kaczmarek, Malta; Eugene Zador, Clifton Park; Sitaramaiah Ravipati, Colonie, all of N.Y.

[73] Assignee: Norton Company, Worcester, Mass.

[21] Appl. No.: 839,243

[22] Filed: Mar. 12, 1986

[51] Int. Cl.[4] ..... B24D 11/00

[52] U.S. Cl. ..... 51/401; 51/298; 51/407; 51/DIG. 34

[58] Field of Search ..... 51/209 R, 295, 298, 51/401, 406, 407, DIG. 34; 427/54.1

[56] References Cited

U.S. PATENT DOCUMENTS

| | | | |
|---|---|---|---|
| 2,357,335 | 9/1944 | Kugler et al. | 51/295 |
| 2,649,667 | 8/1953 | Cooke | 51/209 R |
| 3,408,172 | 10/1968 | Wright et al. | 51/298 X |
| 3,732,647 | 5/1973 | Stith | 51/54 |
| 3,899,050 | 8/1975 | Savary et al. | 51/298 X |
| 4,135,007 | 1/1979 | Lorenz et al. | 427/54.1 X |
| 4,138,229 | 2/1979 | Tadokoro et al. | 51/295 X |
| 4,320,599 | 3/1982 | Hill et al. | 51/58 |
| 4,547,204 | 10/1985 | Caul | 51/298 |
| 4,565,034 | 1/1986 | Sekiya | 51/401 |

FOREIGN PATENT DOCUMENTS

| | | | |
|---|---|---|---|
| 1956810 | 7/1971 | Fed. Rep. of Germany . | |
| 2342869 | 3/1975 | Fed. Rep. of Germany | 51/394 |
| 119491 | 10/1978 | Japan . | |

*Primary Examiner*—Robert P. Olszewski

*Attorney, Agent, or Firm*—Frank S. Chow; Norvell E. Wisdom

[57] ABSTRACT

A coated abrasive which is advantageous for certain applications has at least two distinct layers of abrasive grits: a coarse outer layer and a finer inner layer. The median particle size of the grits in the outer layer is at least 150% of that of the inner layer grits. The grits may be adhered to the backing with adhesives compounded primarily of acrylates and cured by exposure to UV light. A product made in this way is effective for one step fining of plastic ophthalmic lenses.

19 Claims, 2 Drawing Figures

PLURAL LAYERED COATED ABRASIVE

BACKGROUND OF THE INVENTION

1. Field of the Invention

This invention is an example of the general field of coated abrasives, which consist of a plurality of abrasive grit particles distributed over at least one major surface of and adhered to a flexible backing material.

In one specific embodiment, this invention relates to the provision of coated abrasives which can accomplish lens fining in a single step. The term "fining" is an established term of ophthalmic art.

Originally, lens fining with coated abrasives was divided into two steps requiring different coated abrasives for each step. Much commercial use is still made of this two step process, but in recent years at least one type of commercial product capable of accomplishing in a single step what had previously required two steps has been introduced. The prior art product of this type known to the applicants is believed to have only a single grits containing layer with one type of abrasive grits therein.

This invention in its preferred embodiments also relates to the field of adhesives curable by exposure to ultraviolet (hereinafter UV) light.

2. Technical Background

Further descriptions of the the fining process and of suitable machinery for accomplishing it are readily available in prior patents, e. g., U.S. Pat. Nos. 4,320,599 to Hill et al. and 3,732,647 to Stith, the entire specifications of which patents are hereby incorporated herein by reference. A properly designed coated abrasive can be an advantageous type of lapping tool such as is shown as lapping surface 78 of FIG. 2 of the Stith patent, as has been known in general terms heretofore.

In prior art coated abrasives known to the applicants, the abrasive grit particles are normally size graded, which means that grits with sizes greater or lesser than the average or median size for the particular abrasive article by more than a selected ratio are excluded as thoroughly as is practical from the collection of grits making up the article. Normally, all the grits in a single size graded coated abrasive article are part of a single population, so that samples of grits from different areas of the article or from different layers within the depth of the grits coating on the article will have the same distribution of grit sizes as the entire article, within the normal level of statistical variation for random samples of different sizes from the same population.

The use of adhesives capable of rapid cure under the influence of actinic radiation, particularly UV light, has provided attractive combinations of manufacturing speed and adhesive quality in many coating operations, including a wide variety of decorative surface coating, in which relatively thin and transparent adhesive coatings are adequate. Nevertheless, the use of UV cured coating materials for coated abrasives has been very limited. It appears to have been generally believed that the relatively thick layers of adhesives typically required for coated abrasives would be very difficult or impossible to cure with UV light, because of the limited depth of penetration of such light into most appropriate adhesive formulations. Therefore, most of the workers in the field are believed to have concentrated instead on electron beam curing, as exemplified by U.S. Pat. No. 4,547,204 of Oct. 15, 1985 to Caul. Electron beam curing, while effective, requires significantly greater capital investment than curing with UV light and presents a more serious potential hazard to personnel.

German Offenlegungsschrift No. 1956810 published July 21, 1971 purports to describe processes for making coated abrasives with adhesives cured by UV light, but appears to be purely speculative and non-enabling. No working examples are given, and the exposure times suggested are so impractically long—30–300 seconds—that the probable result of trying the suggested process would be the thermal destruction of the backing.

The only published enabling example of a coated abrasive prepared by UV curing known to the applicants is in Japanese Laid-Open Application No. 119491/1978, dated Oct. 18, 1978. This document indicates that the presence of an isocyanate compound in the adhesive is important for success with UV light initiated cure of adhesives for coated abrasives. Furthermore, although it was generally asserted in this Japanese publication that all the formulations disclosed therein are suitable for cure by UV light as well as electron beam curing, only one of the sixteen specific examples actually used UV light, and the adhesive used for this example contained no triacrylated monomers and only a little diacrylated monomer, with the bulk of the adhesive being non-acrylic types of polymerizable unsaturated esters and styrene. The main goal of the art described in this publication appeared to be the use of electron beams with lower than normal energy and of relatively inexpensive adhesives.

A waterproof paper coated abrasive with fast curing adhesives was disclosed in U.S. Pat. No. 4,047,903 to Hesse et al., but this product was cured by electron beam radiation only.

SUMMARY OF THE INVENTION

It has been discovered that an especially advantageous coated abrasive for certain processes can be made by using at least two distinctly different populations of size graded abrasive grits and coating the larger sized grits in a distinct outer layer on top of the inner layer of finer sized grits. When the thickness of the outer layer is properly adapted to the work to be performed, such a design results in a relatively fast initial stock removal and/or surface finish refinement at the beginning of use of the coated abrasive according to this invention, followed by eventual generation of a finer finish on the surface worked by the abrasive than would be achieved if the same size grits were used throughout the depth of the grits coating.

Such a plural layered coated abrasive is especially advantageous for the fining of ophthalmic lenses. Thus, one of the preferred embodiments of this invention is a coated abrasive article suited to one step lens fining.

For convenience of manufacture, adhesives curable by exposure to UV light have been preferably utilized in making the embodiment of this invention for one step lens fining. Styrene and most non-acrylic unsaturated polyesters, as used in Japanese Laid-Open Application No. 119491/1978, have not been found desirable as components of adhesives for this purpose, because their presence in the adhesives usually has led to inferior coated abrasive performance. Instead, adhesives consisting primarily of particular acrylated monomers, vinyl amines, and acrylated oligomers have been found to give superior results. Specific details are given below. High purity aluminum oxide abrasive grits having adequate transmission for UV light are preferred as the abrasive grits. The mass ratio of grits to adhesive is preferably between 1.5 and 2.5 and more preferably between 1.6 and 2.1.

DESCRIPTION OF THE PREFERRED EMBODIMENTS

Adhesive Components

Figure 1:
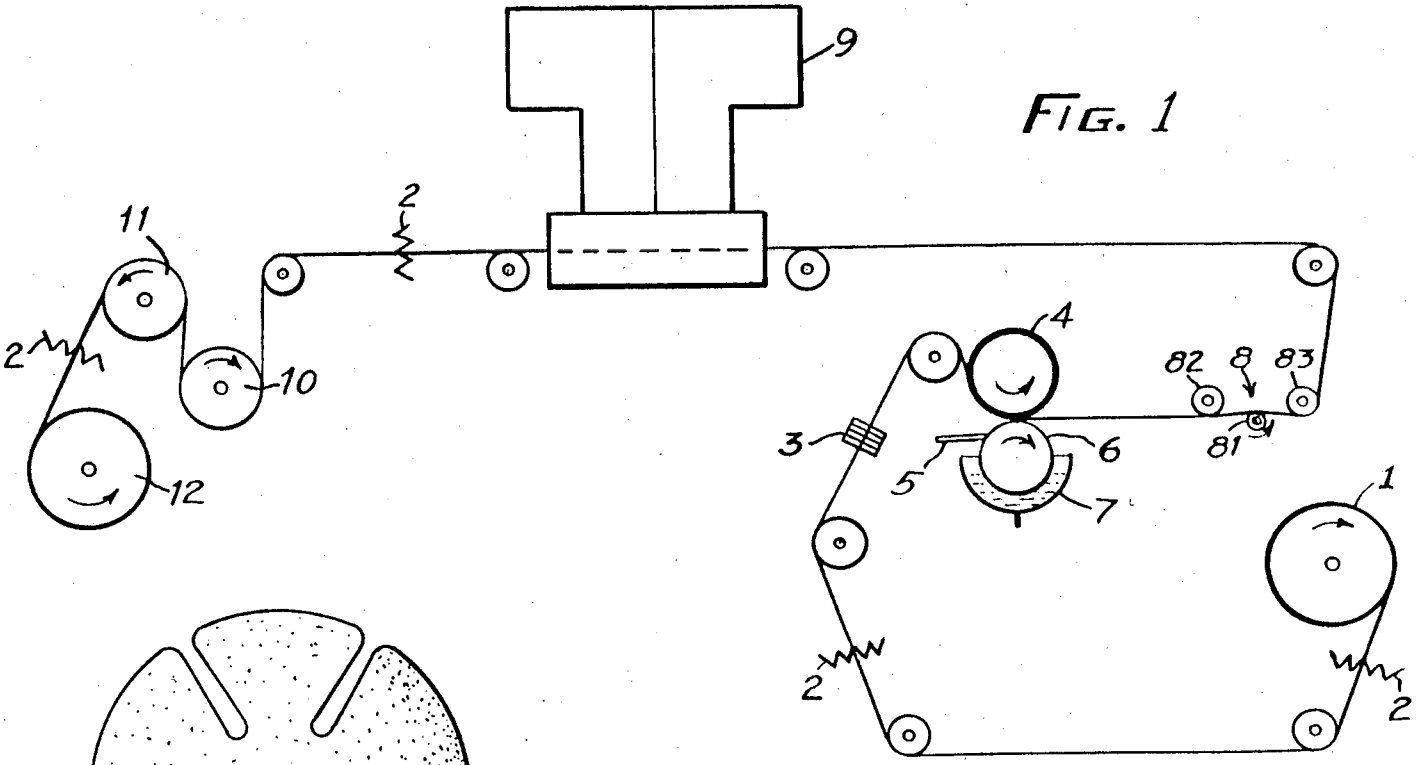
FIG. 1 illustrates a typical process line for continuous production of coated abrasives according to this invention.

Acrylated Monomers:

For most coated abrasive products except the most flexible ones, the most important polymerizable components of the adhesive used for the products according to this invention are the materials generally known commercially as acrylate monomers. We refer to these materials, which are di-, tri-, or higher poly-alcohols that have usually been acrylated to the maximum extent practical, as acrylated monomers for consistency with our other terminology. (It may be noted that both our term and the more common commercial one are chemically correct, because these materials are acrylates and are produced by acrylating alcohols.) Typical commercial products of this class are trimethylolpropane triacrylate (hereinafter TMPTA) and hexanediol diacrylate (hereinafter HDODA).

In order to achieve satisfactory coated abrasive products according to this invention, it is necessary to use substantial amounts of triacrylated monomers. TMPTA is usually preferred as a triacrylated monomer for the practice of this invention, primarily because it is reported to be least likely of all the commercially available triacrylated monomers to cause allergic skin reactions. For certain applications, however, particularly for the adhesive preferred for the outer coating of the products according to this invention, glycidyl propoxy triacrylate (hereinafter GPTA) is preferred. Minor amounts of acrylated monomers with four or more acrylate groups per molecule can be used in lieu of part of the triacrylates.

Adhesives in which all the acrylated monomers have three or more acrylate groups often produce very brittle cured products. It has been found desirable for the adhesive used for the inner grits layer of a one step lens fining product according to this invention to use some diacrylated monomers in the adhesive. The preferred diacrylated monomer is HDODA, but tetraethylene glycol diacrylate and tripropylene glycol diacrylate could also be used. The relative amounts of diacrylated monomers and triacrylated monomers is adjusted along with variations in other components of the adhesive mixture to give suitable viscosity for coating as well as effective grinding and/or finishing characteristics to the coated abrasive ultimately made with the adhesive. A mixture of HDODA and TMPTA in a weight ratio of from 0 to 0.83 is preferred, with ratios from 0.50 to 0.83 most preferred.

Significant amounts of monoacrylated monomers such as ethyl acrylate and methyl methacrylate or of vinyl substituted aromatics such as styrene are not normally desirable in the adhesives because they can retard cure rates and yield cured products which are more brittle than is desirable for fast-cutting coated abrasives.

For all types of acrylated monomers, unsubstituted acrylates are preferred but substituted ones such as methacrylates could be used. The average molecular weight per acrylate unit of suitable monomers varies from 95 to 160, with 95–115 preferred.

Acrylated Oligomers:

For adjustment of the rheology of the adhesive before cure and of the toughness and cutting characteristics of the cured coated abrasive products, it is often advantageous to use acrylated oligomers in addition to the acrylated monomers noted above. The "oligomer" part of the term "acrylated oligomer" refers not to oligomers of acrylates, but rather oligomers of other monomers which yield oligomers bearing hydroxyl or other functional groups suitable for reaction with acrylic acid or anhydride. The preferred acrylated oligomers for a one step lens fining product are (1) the diacrylates of epoxy resins of the bisphenol-A type, for use in the inner grits layer, and (2) tetra- to hexa-acrylates made by reacting oligomers of aromatic diurethanes, with an average oligomer molecular weight of about 750 before reaction, with monomers, such as pentaerythritol triacrylate, that contain at least one hydroxyl group and at least two, preferably three, acrylate groups. Acrylated oligomers are readily available commercially under such tradenames as Celrad from Celanese, Ebecryl from Radcure Specialties, Inc., Uvithane from Thiokol Corporation, Uvimer from Polychrome, Inc., Purelast from Polymer Systems Corporation, etc. Preferred diacrylate oligomers have average molecular weights per acrylate unit of 250 to 900, with a range of 270–400 most preferred.

The tetra- to hexa-acrylated oligomers are preferred when slightly harder cured adhesives are desired, as in the outer layer of the one step lens fining product. Obtaining hardness with an oligomer capped with more than one acrylate on each end is believed to yield cured films with less brittleness than if the same hardness were obtained by increasing the proportion of tri- and higher acrylated monomers instead.

Small amounts of higher and lower oligomers, characteristically present in all practical products of this type, have no known harmful effect. Oligomers terminating with unsubstituted acrylate groups are preferred, but methacrylates or other substituted acrylate groups could also be used.

Amines:

In the prior art, tertiary organic amines have often been added to acrylate adhesive formulations to promote adhesion to particular surfaces. Some of these amines, if unsaturated, are also suitable to serve as viscosity reducers. N-vinyl pyrrolidone (hereinafter NVP) is a suitable unsaturated tertiary amine and is often preferred for the products of our invention.

Preferred Acrylate/Amine Combinations:

The adhesive component for the inner layer of a one step lens fining product as described herein preferably comprises from 100% to 36% by weight of triacrylated monomers, from 0–46% by weight of diacrylated monomers, and from 0–33% by weight of acrylated oligomers. More preferably, the percentage of triacrylated monomer should lie between 70 and 38%. The adhesive component for the outer layer of a one step lens fining product as described herein preferably comprises from 20–30% by weight of triacrylated monomers, from 15–30% by weight of diacrylated monomers, from 15–30% by weight of acrylated oligomers, and from 10–20% of monovinyl tertiary amines.

Photoinitiators:

If cure of the adhesives is to be initiated by UV light as is normally preferred, the adhesive composition must contain a photoinitiator which will adequately absorb and transfer to the acrylate components the energy from the lamps used to initiate cure. Methods for determining the amounts and types of photoinitiator used are conventional in the art of UV cured surface coatings, and the same methods were found effective for purposes of the present invention. The amount of photoinitiator is generally from 0.5 to 7.0% by weight of the amount of adhesive used.

The photoinitiator preferred for the one step lens fining product embodiments of this invention was 2,2-dimethoxy-2-phenyl acetophenone (hereinafter DMPA). However, 2-chlorothioxanthone, benzophenone, and 1-hydroxycyclohexyl phenyl ketone, may also be used, along with many others.

Adhesion Promoters:

A normally preferred component in the adhesive formulations is a material which improves the bonding between the adhesive and the abrasive grits. Most organosilanes and organotitanates containing at least one organic group with from 10–20 carbon atoms have this property. An often preferred material, especially for products to be used for lens fining, was tetrakis[(2,2-diallyloxymethyl)1-butoxy] titanium di(tridecyl) monoacid phosphite (hereinafter OTI).

Colorants:

Dyes or pigments may be used if desired to color the products. However, if UV light is to be used for cure, care must be taken to select colorants which will not unduly absorb the light and thus interfere with the cure.

Fillers:

As with conventional coated abrasives, in many cases it is both economical and advantageous to the product performance to use a finely ground solid filler in the adhesive composition. For purposes of this invention, the UV light absorption of the filler must be considered along with other characteristics considered for normal coated abrasive products. Silica or calcium sulfate filler is preferred, but other fillers with adequate UV transmission could also be used.

Other Product Components

Abrasive Grits:

In general, abrasive grits similar to those used on conventional types of conventional coated abrasives are preferred for coated abrasives made according to this invention for the same applications. However, in the embodiments of this invention featuring adhesive cure by exposure to UV light, white aluminum oxide abrasive grits are usually preferred even though brown aluminum oxide or some other abrasive such as silicon carbide might be preferred for coated abrasives made with normal adhesives. This is true because brown aluminum oxide, zirconia-alumina abrasive, silicon carbide, and most other conventional chemical types of abrasive grits, except for white aluminum oxide and the softer and thus generally less effective silica, are strong absorbers of UV light. Typical satisfactory commercial white aluminum oxide abrasive grits products are Types 38 or 1690 Alundum available from Norton Company, Worcester, Mass., and Alodur WSK from Treibacher USA, Inc., New York City.

Various methods of measuring the size of abrasive grits are known in the art. All of them are subject to some uncertainties and disadvantages, but are generally adequate for the purposes to which they are applied. Any of the standard methods such as sieving, elutriation, sedimentation, a Coulter counter, or the like could be used to measure the grits for products according to this invention.

For grits in the size range suitable for a one step lens fining product, a technique based on the diffraction of laser light has given the most satisfactory results. A commercially manufactured instrument, the MICROTRAC Model 7991-3 Particle Size Analyzer, available from Leeds & Northrup Instruments, St. Petersburg, Fla. 33702, was used. This instrument measures the diffraction of light by a sample of the grits and converts the results into a histogram of the particle sizes.

The values of the least upper bounds on the sizes of the smallest grit particles sufficient in total to comprise 10, 50, and 90 percent by volume of the whole sample are the form of output data from the MICROTRAC which was found most useful for controlling the grit sizes needed for this invention. The size for the 50% volume point is designated herein as the median grit size for the sample of grits.

Abrasive grits according to this invention should be size graded so that the 10% size is at least 45% of the median size and the 90% size is no more than 185% of the median. For the inner layer of a product for one step lens fining, the grits used preferably have a median size between 9 and 11 microns, while for the outer layer the grits should have a median size between 14 and 18 microns. A range of 9.5–10.2 microns for the inner layer and 14.0–15.0 for the outer layer is more preferred. It is additionally preferred that the outer layer of coated abrasives made according to this invention should have grits with a median size which is at least 150% of the median size of the grits in the inner layer.

For a product for one step lens fining according to this invention, it is preferred that the mass ratio of grits to adhesive in the inner layer should be from 1.5 to 2.5, more preferably from 1.6 to 2.1. For the outer layer of the same product, the mass ratio of grits to adhesive is preferably 1.6 to 2.1, more preferably 1.6–1.8.

Backings:

A very wide variety of backing materials may be used for products according to the present invention. This includes backings which are conventional for coated abrasives generally, such as suitably finished cloth, paper, and vulcanized fiber, along with other less conventional backings such as films of polyethylene terephthalate, polyvinyl chloride, aluminum, etc.

For the particular embodiments of this invention especially suited for one step lens fining, it is necessary that the backing should be waterproof, since the product is normally used wet; that the strength of the backing should be sufficient to resist tearing or other damage in use; that the thickness and smoothness of the backing should allow the achievement of the product thickness and smoothness ranges noted further below; and that the adhesion of the adhesive to the backing should be sufficient to prevent significant shedding of the abrasive/adhesive coating during normal use of the product. These requirements are most readily met by the use of plastic films or waterproof paper as the backing. The most preferred backing is polyethylene terephthalate film.

General Processing Characteristics

The adhesive may be applied to the backing by any of the variety of ways generally well known in the coated abrasive art. For example, direct roll coating, transfer roll coating, knife coating, and combinations of these could all be used. The final thickness of separate maker and size layers of adhesive used for manufacturing most general purpose types of coated abrasive should be approximately the same with these adhesives as with conventional ones, so that the thickness of the wet adhesives as applied during manufacture should take appropriate account of the lesser tendency of these adhesives to shrink upon cure than that of conventional adhesives.

The intensity and time of exposure of the products to UV light and to any auxiliary heating used are determined by methods well known in the art of coating with adhesives cured by exposure to UV light, supplemented if necessary by testing of the grinding or other surface finishing performance of the coated abrasives produced. Abrasive grits may be applied to the wet adhesive in any conventional manner, usually by electrocoating. For the embodiments of this invention especially adapted to one step lens fining, however, the grits are slurried with the adhesive, and no size coat is required or desirable.

For lens fining, the thickness of coating in itself is not inherently critical, but a combined thickness of the backing and the product has become established as standard in the industry and is relied upon to give the proper lens curvature when used with the backup lapping tool supports which are conventional. Two thickness ranges, 175–230 microns, and 430–485 microns, are established in the art; both can readily be produced according to this invention and should normally be used unless there is a special reason to deviate from them. The uniformity of thickness is inherently critical, because if the thickness of coating varies excessively from one part of the abrasive to another, it is possible for one part of the lens to escape proper polishing, as a result of a low spot on the abrasive, or to be excessively thinned, by a high spot on the abrasive. The combined thickness of backing and adhesive/abrasive over the surface of the portion of coated abrasive used for a single lens should not vary by more than 25 microns, when measured with an instrument, such as a conventional micrometer, which measures the thickness of local high spots on the coating over an area of at least 0.05 square centimeters.

A method of coating which has been found suitable to achieve the required thickness uniformity other product characteristics in continuous processing is shown schematically in FIG. 1. The backing to be coated is placed on an unwind stand 1 fitted with a brake which can be adjusted to give a resistance to unwinding corresponding to 90 gms force per centimeter of width of the backing. Lengths 2 of loosely suspended copper tinsel connected to an efficient ground are provided on the coating line to eliminate any dangerous build-up of electrostatic charge. Before entering the coating area, the backing is passed between felt wipers 3 to remove any foreign particles which would endanger the uniformity of the coat.

The coating that is to form the inner layer of the final product according to this invention is applied by a direct gravure roll 6 which has a trihelical pattern with sixty-two lines per inch cut with a number eighty-one tool by Consolidated Engravers. The speed of rotation of this roll is maintained so that the periphery of the roll matches the backing in linear speed. Before contacting the backing, the wetted surface of the gravure roll is wiped with a trailing doctor blade 5. A Benton type A blade constructed of Type 304 stainless steel, 203 microns thick and 5 cm wide, with a blade angle of 97° was found satisfactory when used at an angle of 46° to the web at the point of contact. The blade used was supplied by Input Graphics, Inc. The backing web was supported in the coating nip by a non-driven, freely rotating, rubber-coated backup roll 4. The rubber on this roll had a hardness of Shore A-75. For convenience in maintaining cleanliness of the coating, the backup roll was generally undercut so that a zone about six mm in width on each edge of the backing was not subjected to pressure in the nip and thus was not coated.

Adhesive/abrasive slurry was supplied to the gravure roll from a coating pan 7 which was kept filled to a constant level via a recirculation loop not shown. A pump in the recirculation loop maintained constant agitation of the slurry, so that settling of the denser abrasive component did not occur to any significant extent.

After receiving the wet slurry coating on its lower side, the web passes through a texturing bar assembly 8. The texturing bar proper 81 is a case hardened steel bar about 25 mm in diameter. The bar 81 is driven to rotate opposite to the direction of passage of the backing web at a speed about one-third higher than that of the web. The texturing bar is mounted so as to cause a displacement of the web of about 19 mm from the "natural" path it would otherwise assume; this natural path is defined by the lower surface of the two idler rolls 82 and 83, which contact the uncoated back of the web.

After texturing, the wet backing web is passed under a source 9 of UV light. The radiant power of the source 9, together with the heat input of any additional heat source not shown in the Figure but optionally introduced between the outlet from the UV light source and the takedown rubber covered idler contact roll 10 must be sufficient to cause hardening of the adhesive before the web reaches roll 10. An effective UV light source for the formulations described below in preparation of products for lens fining was provided by two successive Model F440-10 lamp holders fitted with one Type D followed by one Type H lamp bulbs, each of the bulbs having a light output of 46 watts per square centimeter. The power supply for each lamp was Type P 140A. All these UV light producing components were supplied by Fusion Systems, Inc. of Rockville, Md.

Roll 10, a rubber covered drive roll 11, and compressed air driven takedown 12 together constitute a conventional takedown assembly, which functions to product a wrinkle-free, tightly wound roll of coated abrasive product.

After the first coating is completed and cured as described above, the once coated roll can be placed on unwind stand 1 for application of the second coating, with a different abrasive-adhesive slurry formulation as specified below. In applying the second coating, which forms the outer layer of the eventual product, the processing is the same excelt that a gravure roll had 85 lines per inch cut with a #35 tool is substituted in position 6 of the Figure, and texturing bar 81 is removed, allowing the web to pass under rolls 82 and 83 without being distorted from its natural straight path.

It will be appreciated by those skilled in the art that many variations of all these coating conditions are possible and are included within the scope of the instant invention.

While the description above has concerned primarily coated abrasives with two distinct layers, it is evident that one or more intermediate adhesive layers, either with or without abrasive grits, could be used between the inner and outer layers described. In such a product, the grits in the outer layer are still adhered to the inner layer, via the intermediate adhesives.

The practice of the instant invention may be further appreciated from the following examples. In these examples, all proportions stated are to be understood as proportions by mass or weight, unless otherwise noted.

EXAMPLE 1

This example illustrates the preparation of an embodiment of the invention suitable for one step lens fining. Biaxially stretched polyethylene terephthalate film with a thickness of 75 microns was used as the backing material. The composit.ion of the first coating layer was:

| | |
|---|---|
| Celrad 3600 | 890 parts |
| TMPTA | 1120 parts |
| HDODA | 927 parts |
| NVP | 743 parts |
| DMPA | 180 parts |
| Zonyl A | 3.7 parts |
| OTI | 6.7 parts |
| Yellow L-0962 | 40 parts |
| Bon Red Y/S | 40 parts |

Abrasive grits, 12 micron 7,267 parts In this formulation, Celrad 3600 is a diacrylated epoxy oligomer of the bisphenol-A type, Zonyl A, supplied by duPont, is a surfactant which aids in wetting the abrasive grits and thereby reduces the viscosity which would otherwise prevail, and Yellow L-0962 and Bon Red Y/S are colorant.s available from BASF and Penn Color respectively. The abrasive grits was type 1690 from Norton Co. The grading analysis of the abrasive grits was performed on the MICROTRAC apparatus already described above, using a sample of grits with a mass of about 0.05–0.2 gms. (The amount of sample must be adjusted according to instructions supplied with the MICROTRAC instrument, but this mass range was usually satisfactory.) The grits were slurried in water and dispersed before measuring their size distribution with the aid of a Sonicator Model W 370 ultrasonic probe instrument, available from Heat Systems-Ultrasonics, Inc., Plainview, N.Y. The result of the analysis showed a 10% size of 5.1 microns, a median size of 9.9 microns, and a 90% size of 17.8 microns. The other ingredients have already been identified.

All but the last three ingredients listed above were readily mixed together without special care to form a "clear coat". About three-fifths of this clear coat was then separately mixed with the two coloring agents for at least 15 minutes to assure thorough mixing; the remainder of the clear coat was then added and mixed until uniform color was achieved. These mixed liquid ingredients are then added to a Ross mixer already containing the abrasive grits, and the slurry thus formed was mixed for one hour to disperse the grits as uniformly as practicable.

A coating of the slurry of adhesive and abrasive grits was spread to a uniform thickness of about 0.9 mil (=0.022 mm) over the surface of the backing, using the coating apparatus shown schematically in FIG. 1. The coated backing was then exposed for 2 seconds to to the output of a mercury vapor UV lamp with radiant power of about 80 watts per centimeter of width.

The backing coated and cured as above was then overcoated with a second slurry of abrasive grits and adhesives. The composition of the second coating was:

| | |
|---|---|
| Ebecryl 6220 | 650 parts |
| TMPTA | 300 parts |
| GPTA | 500 parts |
| HDODA | 750 parts |
| NVP | 550 parts |
| DMPA | 150 parts |
| Zonyl A | 8.5 parts |
| OTI | 5 parts |
| Yellow L-0962 | 30 parts |
| Bon Red Y/S | 30 parts |
| Abrasive grits, 18-S grade | 4,675 parts |

In this formulation, Ebecryl is primarily a hexaacrylated oligomer of an aromatic diurethane, with an average oligomer molecular weight of about 750. The abrasive grits are the same chemical type as for the first coating above, but the grading analysis showed a 10% size of 6.8 microns, a median size of 14.4 microns, and a 90% size of 26.6 microns. The mixing was the same as for the first coating, except that the first eight rather than the first seven ingredients constituted the clear coating for this formula. This slurry was applied in a thickness of 26 microns and cured by exposure to UV lights for two seconds as for the first coating.

Figure 2:
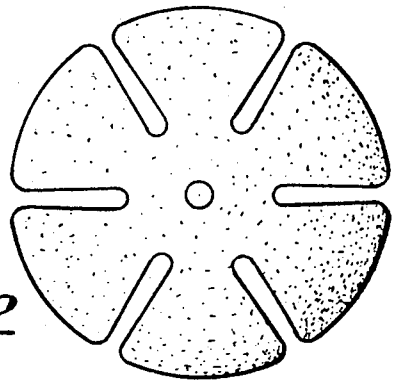
FIG. 2 shown the shape of a representative product of the invention, ready for actual use on a machine as described in the Stith patent.

From the coated abrasive web thereby produced, sections were die cut in the "snowflake" shape shown in FIG. 2. One of these sections was attached with pressure sensitive adhesive to a lapping tool backup structure properly sized and curved to generate lens surfaces of the curvature required for $6\frac{1}{4}$ diopter lenses of 10 cm diameter, said lapping tool backup structure being mounted in a lens polishing machine essentially as described in the Stith patent cited above. An acrylic plastic, $6\frac{1}{4}$ diopter lens blank, with surface as generated by a conventional grit 40 diamond grinding wheel used to shape the proper curvature, was mounted in each of the appropriate positions on the polishing machine, and the pressure urging the coated abrasive lapping tool against the lens blank was adjusted to 9 kg force. The machine was then operated for three minutes.

The criteria prescribed for a successful result of this test are (1) removal of between 0.30 and 0.40 mm from the center of the lens, (2) a lens surface finish of not more than 0.25 microns AA and not more than 2.5 micron depth for the deepest single scratch within a standard traversal range of the surface measuring instrument, (3) general uniformity of the lens surface, and (4) lack of appreciable shedding of the coating of the abrasive lapping tool.

The product made according to this example was highly successful in this test. Product samples were additionally tested in actual use by comparing them to an established commercial product for one step fining of lenses: Fifteen Micron CSF Imperial Lapping Film, supplied by Minnesota Mining and Manufacturing Co. The products of this example were judged at least equal in performance to the commercial product in fining low curvature lenses made of polycarbonate plastic.

EXAMPLE 2

This was the same as Example 1, except that the abrasive grits used in the second coating had a 10% particle size of 8.5 microns, a median particle size of 17.3 microns, and a 90% particle size of 31.4. Performance of this product with larger abrasive grits in the outer layer was adequate according to the criteria stated in Example 1, but the product was not as effective in actual usage tests as the product of Example 1.

What is claimed is:

1. A plural layer coated abrasive, comprising:
(a) a flexible backing;
(b) an inner layer of first size graded abrasive grits distributed over at least one major surface of and adhered to said flexible backing; and
(c) an outer layer of second size graded abrasive grits distributed over and adhered to the side of said inner layer opposite from said backing,
wherein said second size graded abrasive grits have a median size which is at least 150% of the median size of said first size graded abrasive grits.

2. A coated abrasive according to claim 1, wherein said size graded abrasive grits are adhered by means of adhesives which are the cured product of a liquid mixture containing a photoinitiator and susceptible to cure by exposure to UV light.

3. A coated abrasive according to claim 2, wherein said inner layer is a substantially uniform mixture of abrasive grits and adhesive comprising:
(a) an adhesive component comprising (i) from 100% to 36% by weight of triacrylated monomers, (ii) from 0–46% by weight of diacrylated monomers, and (iii) from 0–33% by weight of acrylated oligomers; and
(b) white aluminum oxide abrasive grits having a median particle size between 9 and 11 microns, said abrasive grits being present in the mixture in a mass ratio to the adhesive component of from 1.5 to 2.5.

4. A coated abrasive according to claim 3, wherein said percentage of triacrylated monomer is from 70% to 38% and said abrasive grits have a median particle size between 9.5 and 10.2 microns and are present in a mass ratio to the adhesive component of from 1.6 to 2.1.

5. A coated abrasive according to claim 4, wherein said outer layer is a substantially uniform mixture of abrasive grits and adhesive comprising:
(a) an adhesive component comprising (i) from 20–30% by weight of triacrylated monomers, (ii) from 15–30% by weight of diacrylated monomers, (iii) from 15–30% by weight of acrylated oligomers, and (iv) from 10–20% of monovinyl tertiary amines; and
(b) white aluminum oxide abrasive grits having a median size from 14–18 microns, said abrasive grits being present in the mixture in a weight ratio to the adhesive component of from 1.6 to 2.1.

6. A coated abrasive according to claim 5, wherein said abrasive grits have a median particle size from 14.0–15.0 microns and are present in a mass ratio to said adhesive of from 1.6–1.8.

7. A coated abrasive according to claim 3, wherein said outer layer is a substantially uniform mixture of abrasive grits and adhesive comprising:
(a) an adhesive component comprising (i) from 20–30% by weight of triacrylated monomers, (ii) from 15–30% by weight of diacrylated monomers, (iii) from 15–30% by weight of acrylated oligomers, and (iv) from 10–20% of monovinyl tertiary amines; and
(b) white aluminum oxide abrasive grits having a median size from 14–18 microns, said abrasive grits being present in the mixture in a weight ratio to the adhesive component of from 1.6 to 2.1.

8. A coated abrasive according to claim 7, wherein said abrasive grits have a median particle size from 14.0–15.0 microns and are present in a mass ratio to said adhesive of from 1.6–1.8.

9. A coated abrasive according to claim 2, wherein said outer layer is a substantially uniform mixture of abrasive grits and adhesive comprising:
(a) an adhesive component comprising (i) from 20–30% by weight of triacrylated monomers, (ii) from 15–30% by weight of diacrylated monomers, (iii) from 15–30% by weight of acrylated oligomers, and (iv) from 10–20% of monovinyl tertiary amines; and
(b) white aluminum oxide abrasive grits having a median size from 14–18 microns, said abrasive grits being present in the mixture in a weight ratio to the adhesive component of from 1.6 to 2.1.

10. A coated abrasive according to claim 9, wherein said abrasive grits have a median particle size from 14.0–15.0 microns and are present in a mass ratio to said adhesive of from 1.6–1.8.

11. A coated abrasive according to claim 1, wherein said outer layer is a substantially uniform mixture of abrasive grits and adhesive comprising:
(a) an adhesive component comprising (i) from 20–30% by weight of triacrylated monomers, (ii) from 15–30% by weight of diacrylated monomers, (iii) from 15–30% by weight of acrylated oligomers, and (iv) from 10–20% of monovinyl tertiary amines; and
(b) white aluminum oxide abrasive grits having a median size from 14–18 microns, said abrasive grits being present in the mixture in a weight ratio to the adhesive component of from 1.6 to 2.1.

12. A coated abrasive according to claim 11, wherein said abrasive grits have a median particle size from 14.0–15.0 microns and are present in a mass ratio to said adhesive of from 1.6–1.8.

13. A coated abrasive according to claim 12, wherein at least half of said acrylated oligomers in the adhesive of said outer layer have at least four acrylate groups per molecule.

14. A coated abrasive according to claim 11, wherein at least half of said acrylated oligomers in the adhesive of said outer layer have at least four acrylate groups per molecule.

15. A coated abrasive according to claim 10, wherein at least half of said acrylated oligomers in the adhesive of said outer layer have at least four acrylate groups per molecule.

16. A coated abrasive according to claim 9, wherein at least half of said acrylated oligomers in the adhesive of said outer layer have at least four acrylate groups per molecule.

17. A coated abrasive according to claim 8, wherein at least half of said acrylated oligomers in the adhesive of said outer layer have at least four acrylate groups per molecule.

18. A coated abrasive according to claim 7, wherein at least half of said acrylated oligomers in the adhesive of said outer layer have at least four acrylate groups per molecule.

19. A coated abrasive according to claim 6, wherein at least half of said acrylated oligomers in the adhesive of said outer layer have at least four acrylate groups per molecule.

* * * * *